US005761377A

United States Patent [19]

Wolfe et al.

[11] Patent Number: 5,761,377

[45] Date of Patent: Jun. 2, 1998

[54] TOWER TYPE PORTABLE RADIANT HEATER

[75] Inventors: Robert E. Wolfe, Holliston; Johnson Hsu, Framingham; Dov Z. Glucksman, Wenham; Karl Weidemann, Hull, all of Mass.

[73] Assignee: Holmes Products Corporation, Milford, Mass.

[21] Appl. No.: 731,922

[22] Filed: Oct. 22, 1996

Related U.S. Application Data

[63] Continuation of Ser. No. 534,942, Sep. 28, 1995.

[51] Int. Cl.[6] ..... F24H 3/02

[52] U.S. Cl. ..... 392/376; 392/373; 392/375; 392/422

[58] Field of Search ..... 392/360, 361, 392/363–370, 373, 375–385; D23/328, 335, 340

[56] References Cited

U.S. PATENT DOCUMENTS

| | | | |
|---|---|---|---|
| D. 281,811 | 6/1985 | Horst, Sr. | D23/122 |
| D. 325,251 | 4/1992 | Schindler et al. | D23/328 |
| D. 329,692 | 9/1992 | Chaney et al. | D23/340 |
| 1,900,956 | 3/1933 | Somersall . | |
| 2,410,211 | 10/1946 | Gough | 392/376 |
| 2,433,137 | 12/1947 | Marr | 392/376 |
| 2,475,180 | 7/1949 | Fitch | 392/375 |
| 2,528,650 | 11/1950 | Graham | 392/375 |
| 3,051,820 | 7/1962 | Krichton | 392/376 |
| 3,229,070 | 1/1966 | Wells . | |
| 3,775,590 | 11/1973 | Gartner . | |
| 4,004,128 | 1/1977 | Marchesi . | |
| 4,164,642 | 8/1979 | Ebert . | |
| 4,336,442 | 6/1982 | Starr . | |
| 4,682,009 | 7/1987 | Meiser et al. . | |
| 5,092,518 | 3/1992 | Tomioka et al. . | |
| 5,381,509 | 1/1995 | Mills . | |
| 5,437,001 | 7/1995 | Chaney et al. | 392/376 |

FOREIGN PATENT DOCUMENTS

| | | | |
|---|---|---|---|
| 130580 | 12/1948 | Australia | 392/376 |
| 57-150738 | 9/1982 | Japan | 392/376 |
| 58-85022 | 5/1983 | Japan | 392/376 |
| 58-85023 | 5/1983 | Japan | 392/376 |
| 885919 | 1/1962 | United Kingdom | 392/376 |

OTHER PUBLICATIONS

Advertisement for Patton WH–80 heater from "Heartland America" catalog, Item J7–3812, Nov. 1994.

Advertisement for Accutek Heater Fan from "Improvements" catalog, Item 134007, Sep. 1, 1995.

*Primary Examiner*—Tu B. Hoang

*Attorney, Agent, or Firm*—Hoffman & Baron, LLP

[57] ABSTRACT

A portable heater providing both radiant and forced air heat includes a plurality of vertically oriented, horizontally spaced apart quartz heating tubes is partially surrounded by a common reflector configured to open at an obtuse angle at each quartz tube. The reflector is perforated to allow air to pass out from the interior of the heater. A housing surrounds the reflector and heating elements. A fan located toward the top of the heater draws air inward and down the channels behind the reflector from which it emerges past the heating elements. Control knobs for controlling a thermostat and output power level are located at the top surface of the housing. The heater also has automatic safety controls for shutting off power in the event the heater tips over or overheats, and an overcurrent device.

6 Claims, 4 Drawing Sheets

TOWER TYPE PORTABLE RADIANT HEATER

This application is a continuation of copending application Ser. No. 08/534,942 filed on Sep. 28, 1995.

BACKGROUND OF THE INVENTION

1. Field of the Invention

The present invention relates to a portable radiant heater and more particularly to an electrically powered quartz element radiant heater incorporating a fan for forcing air past a reflector surface and out into a space. The air absorbs heat from the quartz elements and surfaces of the heater, and is discharged forward from the heater, thereby augmenting radiant heating. An additional benefit of this air flow is to limit maximum temperature of the reflector, among other components of the radiant heater. The reflector partially wraps around several vertically oriented tubular heating elements.

2. Description of the Prior Art

Supplementary heat for limited spaces may be provided by portable heaters. Typically electrical, portable heaters may distribute heat by convection, forced air, radiation, or a combination of these. Radiant heaters have become popular since they are capable of heating solid objects within reach of the radiant heat, but they do not heat ambient air surrounding these objects. Thus, a person in the room or space benefits from the heat, although the air temperature is not greatly increased.

However, only surfaces exposed to the source of radiant heat experience heating. If, for example, a person standing by a radiant heat source turns, or if another person or object is interposed between the standing person and the heat source, the warmed part of the standing person will chill. To even the heating effect, it becomes desirable to both project radiant heat and to warm the air of the space or room.

To provide this benefit, combination radiant and forced air heaters have been proposed in the prior art. U.S. Pat. No. 5,381,509, issued to Thomas H. Mills on Jan. 10, 1995, describes such a combination of forced air and radiant heater. The heater has a reflector plate for projecting radiated heat forwardly out from the heater, and a fan located behind the reflector plate for forcing air upwardly and out from the heater. Unlike the present invention, air does not pass through the reflector plate. Also, the reflector plate has horizontal ridges, which tend to interfere with upward migration of forced air by inducing turbulence in the air stream. Unlike the present invention, the fan of the Mills heater is located at the lower extremity of the heater.

U.S. Pat. No. 3,229,070, issued to Orville C. Wells on Jan. 11, 1966, incorporated herein by reference describes a portable forced air and radiant electric heater which illustrates typical features such as manual on-off switch, thermostatic switch for protection against overheating, heating element guard for preventing direct contact by an external object, and fins for directing airflow. The fan draws air down through the center and directs it out the sides over the circular heating rod. The Wells invention acts primarily as a conventional conductive heater where air is the conductive medium. There is no optimization of radiant heat dispersion as by a reflector.

An industrial convection and radiant heater is shown in U.S. Pat. No. 4,336,442, issued to Eugene W. Starr on Jun. 22, 1982. Due to its industrial application, the direction of radiation and egress of heated air differs from those of the present invention. Because it is handling pressurized heated gas, Starr's device handles heated air in conduits not found in the present invention. Also, there are no manual controls located on the top of the device, as would befit a consumer space heating appliance.

U.S. Pat. No. 1,900,956, issued to William W. Somersall on Mar. 14, 1933, sets forth an upright, portable electric heater with air forced out radially at the top. This device humidifies occupied space by heating water contained above the heat source. The heater of Somersall lacks radiant heat dispersion, and the forced air heat extraction of the instant invention.

U.S. Pat. No. 3,775,590, issued to William Joseph Gartner on Nov. 27, 1973, describes a portable forced air heater which features a fan mounted toward the top of the heater, and which discharges air horizontally and radially from the top of the heater. Unlike the present invention, there is no significant degree of radiant heating provided by this device. Air flow is different in the present invention, passing through a reflector plate absent in the Gartner device. Also, Gartner locates a manual control near the bottom of the heater. By contrast, controls are conveniently located at the top of the present novel heater.

In U.S. Pat. No. 5,092,518, issued to Mituharu Tomioka et al. on Mar. 3, 1992, there is presented a combustion heater which features forced ejection of heated air. The thrust of the invention is to make constant the reach of projected heated air regardless of the amount of heat being dispersed. This is a forced air heater, and unlike the present invention, there is no significant propagation of heat by radiation.

A portable radiant heater is shown in U.S. Pat. No. 4,004,128, issued to Carlo Marchesi on Jan. 18, 1977. This heater surrounds a heating element with a thermal mass, which absorbs heat and radiates heat over a period of time extending beyond the period of time during which the heating element is energized. Unlike the present invention, this heater lacks a reflector and a forced air fan.

A radiant heater described in U.S. Pat. No. 4,164,642, issued to Edward A. Ebert on Aug. 14, 1979, is employed to heat eyeglass frames. A perforated metallic sheet is interposed between the heating element and an eyeglass frame. The metallic sheet absorbs energy of a given wavelength, and retransmits energy of another wavelength. Energy passing unobstructed through the perforations combine with retransmitted energy to assure that radiant energy of different wavelengths strikes the eyeglass frame. Unlike the present invention, the metallic sheet varies radiant energy wavelengths by passing some radiated heat from the heating element through the perforations, and by retransmitting heat at different wavelengths as the sheet is heated. Also unlike the present invention, there is no forced air transmission of heat from Ebert's heater.

A convection heater is described in U.S. Pat. No. 4,682,009, issued to Roland Meiser et al. on Jul. 21, 1987. Unlike the present invention, this invention is a convection heater providing neither significant radiated heat nor a fan for forcing air.

None of the above inventions and patents, taken either singly or in combination, is seen to describe the instant invention as claimed.

SUMMARY OF THE INVENTION

The present invention adds a number of practical and effective features to radiant heaters. Radiant heating is made highly effective by providing two vertical columns of quartz heating tubes, partially surrounded by a common reflector.

The reflector is perforated, and wraps partially around each vertical column of tubes, opening at an obtuse angle at each vertical column. In this manner, radiated heat propagates from a broad field, as opposed to a point source or even a linear source. This feature provides stereoscopic propagation, so that persons turning their bodies at slightly different angles are less apt to feel chilled as parts of the body formerly directly exposed to radiant heat subsequently intercepts this heat at an oblique angle.

In contrast to prior art, the present invention has a reflector plate for reflecting and directing radiant heat from the heating element. Air flow through the heater passes through holes formed in the reflector, thus both heating the air and limiting the maximum temperature of the reflector. Heated air is discharged laterally along the housing, and thus complements radiant heat. Complementary forced air heat will reach areas of a room obscured from line-of-sight propagation of radiant heat.

A fan is located at the top of the housing, thus drawing in cooler air from above over the controls, in behind the reflector and out through holes in the reflector. This location enables the fan to draw in cleaner air, warm it and exit above the floor without disturbing dust and other particulates which may accumulate along floors and carpets. It may locate the fan downstream with respect to a screen or filter, so that the fan blades enjoy reduced tendency to become encumbered with dust and other contaminants.

Electrical controls, including manual operating controls and safety controls, are provided. Operating controls, conveniently accessible at the top of the heater, include an on-off function, two levels of heat output, and temperature selection. The thermostat providing temperature selection has a minimum setting of 32° F. for freeze protection. The top location of manual controls is quickly discerned by a person seeking to adjust the heater, and also minimizes the degree to which a user must bend over to operate the controls.

Safety controls include tip-over shut off, high heat limiter, and overcurrent protection. The tip-over switch provides fast response should the heater fall or even incline to a certain degree. The high heat limiter takes the form of a snap action switch exposed to the heat of the flow of heated air. Two indicating lamps are provided, one signalling that the heater is connected to electrical power even if not operating, and the other signaling that an over-temperature condition has occurred.

Accordingly, it is one object of the invention to provide a radiant heater projecting radiant heat at a maximal angle of propagation and from a broad, field source, as opposed to a point source or a linear source, for even heating.

It is another object of the invention to supplement radiant heat by forced air currents being drawn in around the top sides of the heater and passing out through a reflector along the vertical axis of the heater.

Still another object of the invention is to limit maximum temperatures attained by the reflector, controls and upper handle.

An additional object of the invention is to locate manual controls conveniently, at the top of the heater.

It is again an object of the invention to provide manual selection of temperature actuating the heater and master on-off control.

Yet another object of the invention is to provide immediate interruption of electrical power in the event of tip-over, and interruption of electrical power responsive to overheating and overcurrent conditions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
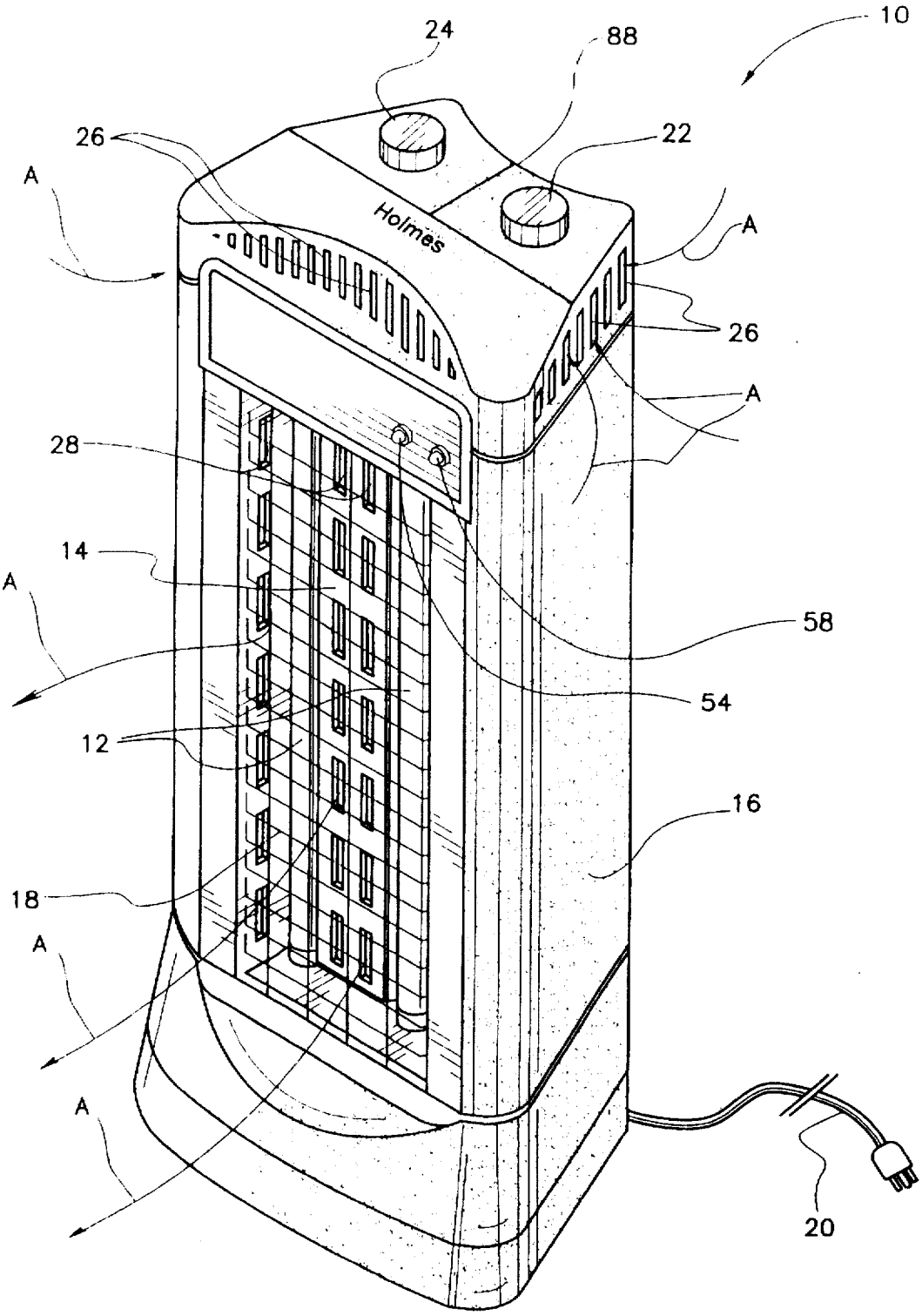
FIG. 1 is a perspective view of the invention showing air intake and exit.

Turning now to FIG. 1 of the drawings, the present invention concerns a portable radiant heater 10 having two vertically oriented heating elements 12 partially surrounded by a reflector 14. Each vertical heating element could, of course, comprise a plurality of heating elements located in stacked or serial arrangement in columns. It is further possible to provide three or more vertical columns of heating elements. The heater thus provided will retain air flow characteristics of the two column embodiment, as long as the projecting crests and valleys defined there between, remain vertical.

A housing 16 partially encloses reflector 14, and a grille 18 covers heating elements 12. Heater 10 is a unitary device, not requiring assembly for deployment, and has a power cord 20 fitted with a power plug for supplying electrical power from a household electrical receptacle (not shown).

Novel heater 10 is of the tower type, greater in height than in width or depth. This configuration occupies minimal floor area, affords more convenient access to control knobs 22, 24 located at the top of heater 10, and improves the dispersion pattern of radiant heat. Specifically, in simulating or paralleling erect posture of a typical human occupant of a room, radiant heat falls more evenly over the occupant than would occur from a horizontal bodied heater supported on the floor of the room. Radiant heat is supplemented by heated air discharged from holes or slots 28 formed in the vertical reflector of heater 10.

Air flow in at the top is indicated by inward directed arrows marked with "A". Air flow out the front through openings in the reflector is indicated by outward directed arrows marked with "A".

Power on switch 54 and caution light 58 appear on the front of the unit near the top. A reset button (not shown) 62 is located on the back and a thermal cut-out switch 48 is mounted near the top of the reflector 14. An inset area (not shown) forms a grip for handle 88.

Figure 2:
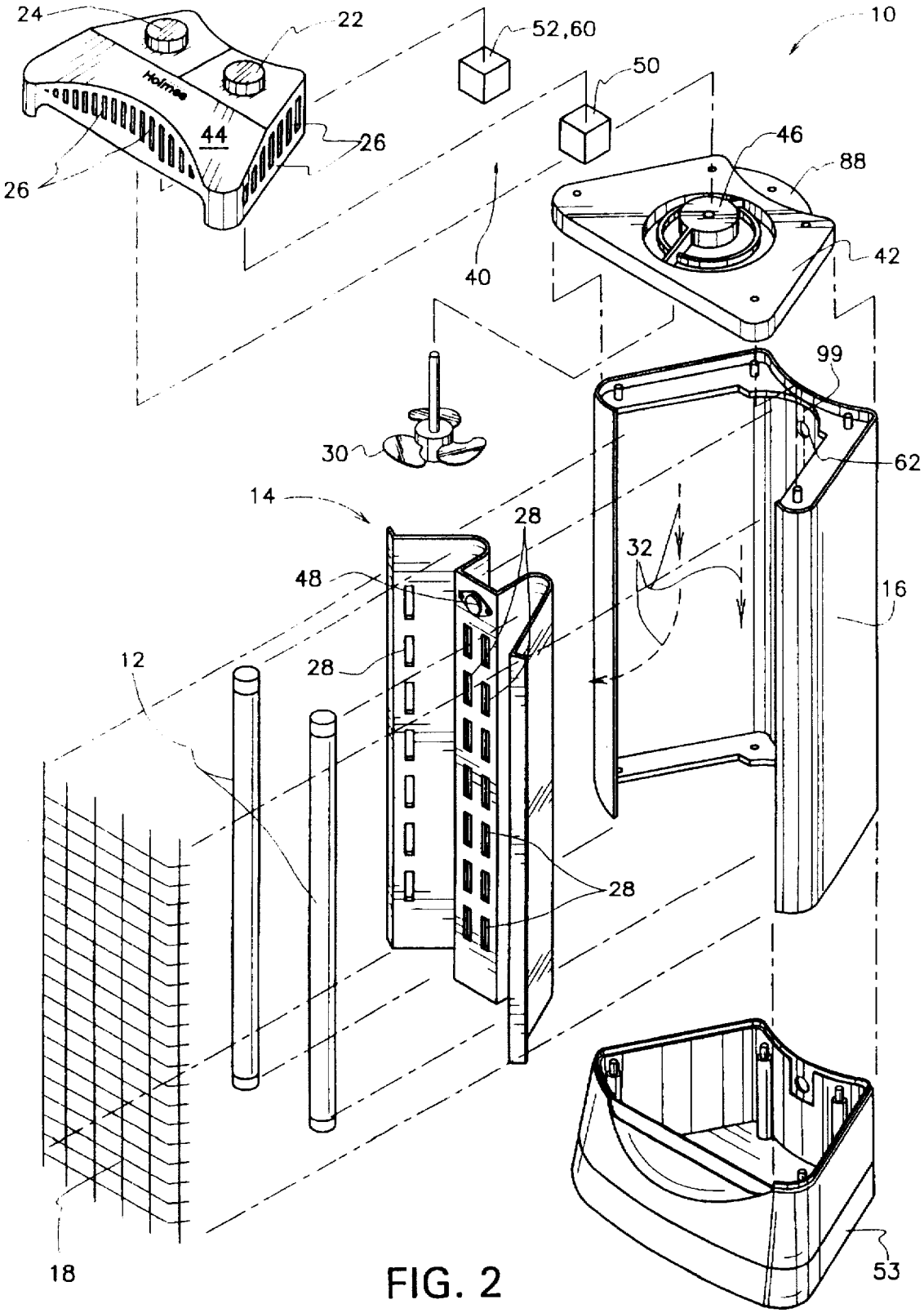
FIG. 2 is an exploded, perspective view of the invention.

FIG. 2 shows internal components of heater 10. The essence of the invention lies in cooperation of critical components with the upright or tower configuration. This cooperation enhances effectiveness of the heater, and will be briefly summarized prior to description of the components.

Room air is drawn in through slots 26 around the top of the heater. Most of this air exits through perforations 28 in the reflector 14 and is heated by the reflector and the heating elements. Several advantages are realized through this arrangement, notably that ambient air is drawn across top mounted controls, the grip area 88 and the fan motor keeping them cooler and prolonging life and reflector material 14 does not get as hot as it otherwise would if there were no air circulation or if the air direction were reversed.

Also, as this air absorbs heat from reflector 14, the maximum temperature attained by reflector 14 is limited. This is a significant safety consideration. It should especially be noted that the portion of reflector 14 having perforations 28 is located near two sources of intense heat, and could otherwise attain temperatures well within the ignition range of household inflammables if not cooled by air flow. Air flow through channels behind reflector 14 is indicated with arrows 32.

A reset button 62 is located on the back of the housing 16 and a thermal cut-out switch 48 is mounted on the reflector 14. The location of the cut-out switch is important to the safe functioning of the heater. By placing it on the reflector surface, it is best able to detect heat build-up which typically arises from being turned towards a wall or drapery or from towels or articles of clothing hanging nearby.

An inset area (not shown) forms a grip for handle 88. This is an added safety feature as the user might otherwise grasp the heater in hotter areas.

The air flow pattern of this invention produces another originally unanticipated benefit. By keeping the temperature of the housing 16 cooler, a variety of moldable plastics could be used. Subsequently it occurred to us that the housing 16 could be molded in one piece by creating a living hinge 99 at the center of the housing down its length. This innovation greatly reduced costs for production and assembly as well as contributing to general aesthetics and marketability.

Figure 3:
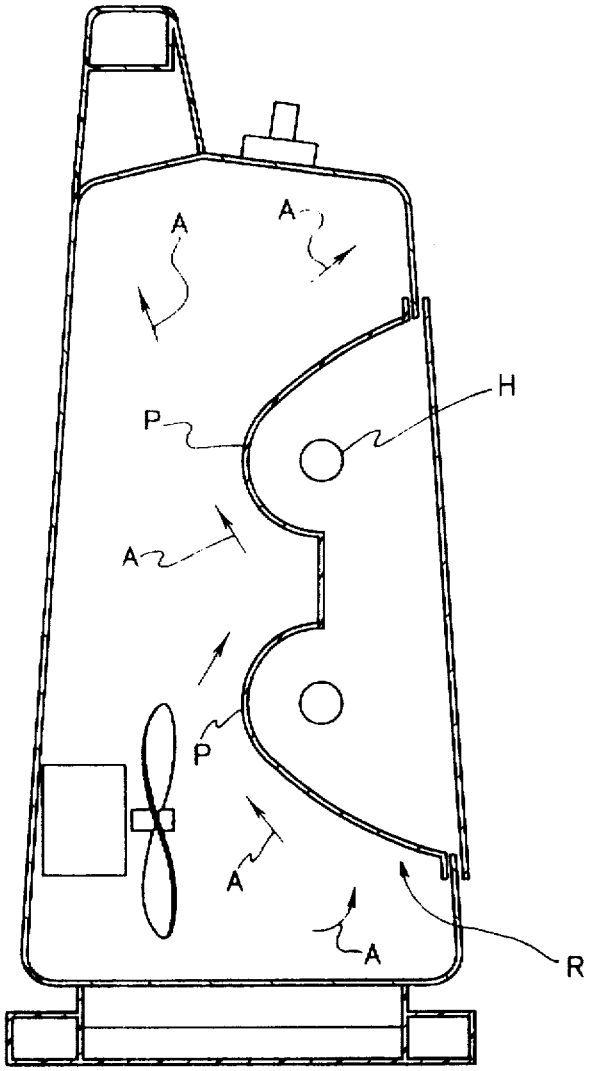
FIG. 3 PRIOR ART
FIG. 3 is a side elevational, cross sectional view of a prior art heater, showing typical air flow in prior art devices.

FIG. 3 illustrates horizontal projections P which are present in a prior art radiant heater having a reflector R which partially surrounds and cooperates with heater elements H in a known prior art device. This illustration is provided to contrast turbulence and indirect air flow, indicated by arrows A, resulting from cooperation of reflector R with horizontally oriented heating elements H, as contrasted with the unimpeded vertical column of air in the present invention, indicated at 32 (see FIG. 2), resulting from vertical orientation of the heating elements.

Figure 4:
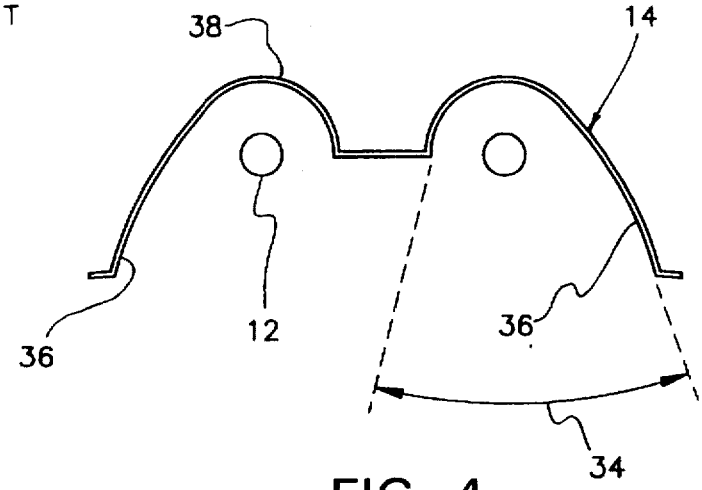
FIG. 4 is a diagrammatic, top plan detail view of the reflector and heating elements of the novel heater.

Referring now to FIG. 4, reflector 14 cooperates with and partially surrounds each heating element 12, opening outwardly at an obtuse angle 34. Formed to include this angle 34, reflector 14 projects radiant heat from its front surface 36 into the room or space being heated. Rear surface 38 of reflector 14 is exposed to the falling column 32 (see FIG. 2) of air directed down and out by the fan within heater 10.

Returning to FIG. 2, it will be seen that housing 16 has a lateral wall partially surrounding heating elements 12 and reflector 14. This relationship exposes heating elements 12 and reflector 14 to project radiant heat to the front of heater 10, and also defines an air flow chamber existing between reflector 14 and the lateral wall of housing 16 enveloping air currents indicated at 32.

Housing 16 includes an upper section 40 partially separated from the air flow chamber. As depicted, upper section 40 is defined by a floor 42 and cap 44. Floor 42 provides a top surface sealing the top or upper end of housing 16. Cap 44 has openings 26 for drawing in room air laterally to heater 10. When assembled, upper section 40 comprises a chamber housing the motor 46 of fan 30, a thermostat 52 operated by knob 24 through an appropriate shaft (not shown), and a heater operation control switch 50 controlling power output level operated by knob 22. Housing 16 is sealed at the bottom by a base 53.

A novel method for producing the housing has been discovered. By molding the two vertical sides of the housing as one continuous piece, certain economies were realized. In order to produce the required shape while reducing mold complexity, the halves of the housing needed to be laid open so that side pieces are at least 90 degrees from the mold base (to allow for release). By employing a living hinge concept (using a thin flexible connecting strip between the two halves) this was made possible. When the housing is removed from the mold, it is pushed together (preferably while still warm and held in the desired configuration until cool).

Figure 5:
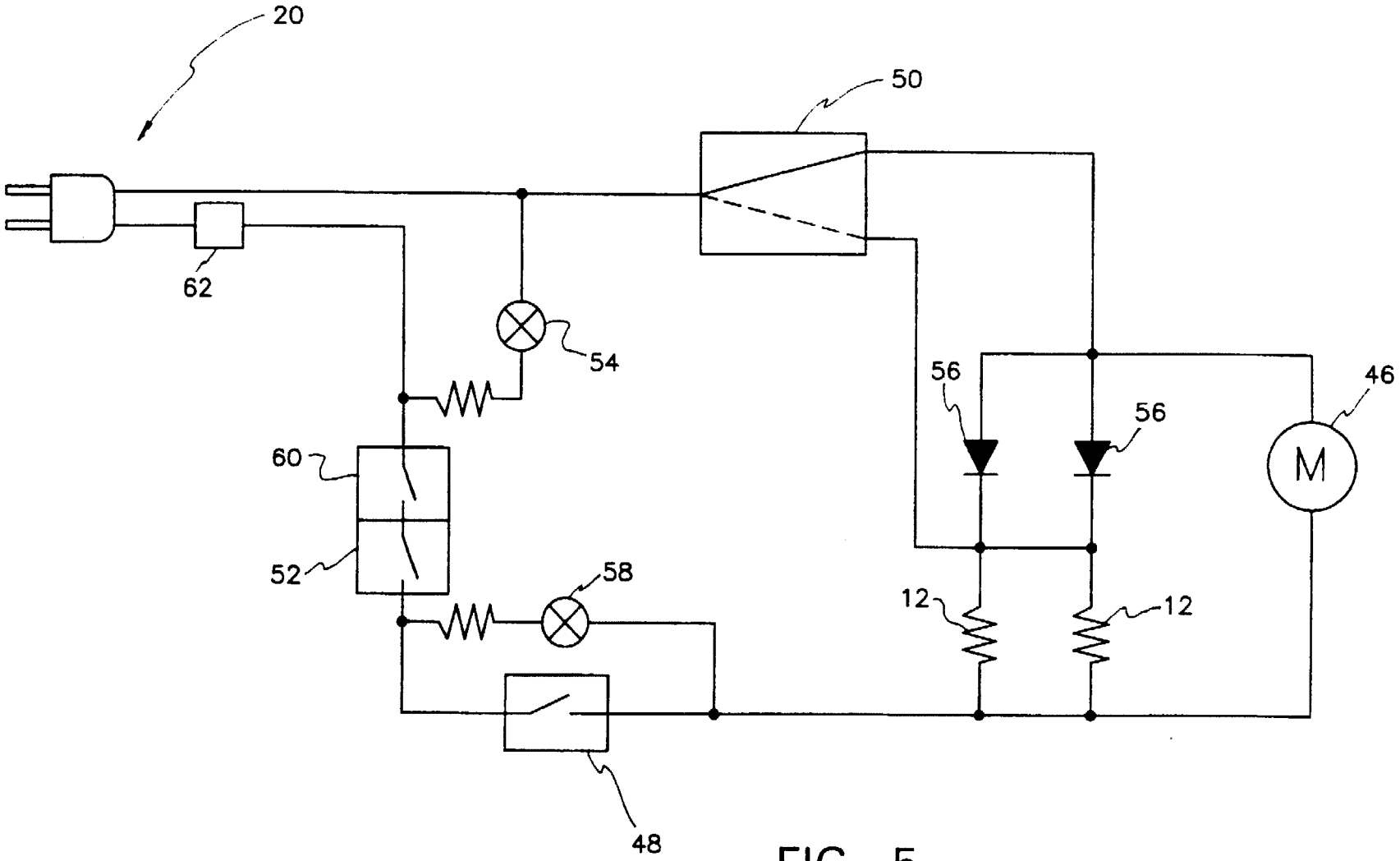
FIG. 5 is an electrical diagram of simplified electrical circuitry of the novel heater.

FIG. 5 shows electrical circuitry of heater 10. Power supplied through cord and plug 20 is signalled by an indicating lamp 54 merely indicating that heater 10 is connected to power, and that ordinary precautions pertaining to any energized appliance would be appropriate. Switch 50 offers the choice of two levels of power output connected to heating elements 12, this being controlled by appropriate diodes 56. Fan motor 46 is energized in either power level selected by switch 50.

Thermostatic reset switch 48 is an automatic safety device comprising, preferably, a thermally responsive, snap action switch subjected to the heat from the front of the reflector 14. Switch 48 is located in series within the electrical circuitry so as to control all power. Switch 48 has a metallic element which flexes, or snaps, when subjected to a predetermined temperature. Flexure operates switch contacts (not shown), thus breaking electrical continuity at temperatures above the predetermined temperature. At temperatures below the predetermined temperature, the metallic element flexes back to its original position, and switch returns to a normally closed position.

A second indicating lamp 58 (caution light) is placed in parallel with switch 48, and illuminates should switch 48 break contact. This signals that switch 48 has detected and responded to a potentially dangerous high temperature.

Thermostat 52 is manually adjustable, and operates by controlling all power flowing in the electrical circuitry. Thermostat 52 provides the user with control over the temperature at which heater 10 will operate. This control function is separate from the level of power output selected by switch 50. On-off control may be provided either by selecting an appropriate actuating temperature at thermostat 52, or by incorporation of an "off" position in switch 50.

Thermostat 52 also incorporates a tip-over switch 60. Switch 60 is preferably a pendulum switch, which opens switch contacts when heater 10 is not in its normal, upright position. Switch 60 could comprise a mercury switch or any other suitable switch responsive to inclination of heater 10 from its normal, upright position.

As a further safety feature, an overcurrent device 62 is located in series within the electrical circuitry. Device 62 is a fuse or circuit breaker, as desired, selected to break all power responsive to detection of electrical current exceeding a predetermined magnitude.

Thus, it will be seen that both manual controlled switches 50 and 52, and automatic safety devices 48, 60, and 62, all are placed in series so as to control all power flowing within electrical circuitry. This arrangement effectively de-energizes all components, thus assuring safety regardless of the source of a potential fault.

It is to be understood that the present invention is not limited to the embodiments described above, but encompasses any and all embodiments within the scope of the following claims.

We claim:

1. A portable heater for providing radiant and convection heat, said heater comprising:

a housing including an upper end, a lower end, a rear portion and a front portion, said housing further including an air inlet located at said upper end, an air outlet located at said front portion and an air flow chamber therebetween and along the length of said housing;

at least one vertically oriented heating element;

a reflector disposed between said at least one heating element and said rear portion of said housing such that said air flow chamber is substantially defined by a vertical column formed by said reflector and said rear portion of said housing, said reflector partially surrounding said at least one heating element and opening outwardly at an obtuse angle about each of said at least one heating element for creating a direct path of communication between said upper end of the housing and said vertical column of the reflector, said reflector having a front surface capable of projecting radiant heat out of said heater through said air outlet;

perforations extending through said reflector, said perforations arranged at least along said vertical column for creating a path of communication between said air flow chamber and said air outlet permitting passage of air across said at least one heating element;

a fan mounted within said upper end and interposed between said reflector and said air inlet for propelling air into said air flow chamber; and electrical circuitry including fan controls, said electrical circuitry supplying power to said at least one heating element, said electrical circuitry being located at said upper end of said housing;

whereby said at least one heating element provides radiant heat and whereby said fan causes air to pass in through said air inlet, into said air flow chamber, through said perforations, across said at least one heating element and out said air outlet, whereby said air is caused to be heated by said at least one heating element and said electrical circuitry is substantially cooled by air passing through said air inlet.

2. A portable heater as in claim 1, wherein said at least one heating element comprises two heating elements.

3. A portable heater as in claim 1, wherein said at least one heating element comprises a plurality of heating elements in a stacked arrangement.

4. A portable heater as in claim 1, further comprising a tip-over switch for detecting inclination of said portable heater, said tip-over switch breaking all power flowing in said electrical circuitry in response to inclination of said portable heater.

5. A portable heater as in claim 1, further comprising a snap action switch capable of interrupting all power in said electrical circuitry when said circuitry is subjected to a predetermined temperature.

6. A portable heater as in claim 5, wherein said snap action switch is located on said reflector.

* * * * *